United States Patent [19]

Schrewe et al.

[11] 4,413,667

[45] Nov. 8, 1983

[54] SUPERVISING THE INCLINATION OF MOLD SIDES

[75] Inventors: Hans Schrewe, Düsseldorf; Lothar Parschat, Essen; Klaus Franken, Krefeld; Peter Geisbüsch, Ratingen, all of Fed. Rep. of Germany

[73] Assignee: Mannesmann Aktiengesellschaft, Düsseldorf, Fed. Rep. of Germany

[21] Appl. No.: 356,302

[22] Filed: Mar. 10, 1982

[30] Foreign Application Priority Data

Mar. 11, 1981 [DE] Fed. Rep. of Germany ..... 3110012

[51] Int. Cl.[3] ..... B22D 11/16; B22D 11/04; B22D 11/10

[52] U.S. Cl. ..... 164/154; 164/436; 164/452; 164/491

[58] Field of Search ..... 164/413, 414, 436, 451, 164/452, 454, 491, 455, 154

[56] References Cited

U.S. PATENT DOCUMENTS

| | | | |
|---|---|---|---|
| 3,838,730 | 10/1974 | Nagaoka et al. | 164/436 |
| 3,926,244 | 12/1975 | Meier et al. | 164/455 |
| 3,933,192 | 1/1976 | Rodenchuk et al. | 164/436 X |
| 4,171,719 | 10/1979 | Wünnenberg et al. | 164/436 X |
| 4,356,860 | 11/1982 | Gladwin | 164/436 X |

FOREIGN PATENT DOCUMENTS

| | | |
|---|---|---|
| 2340768 | 2/1974 | Fed. Rep. of Germany . |
| 2415224 | 2/1977 | Fed. Rep. of Germany . |

*Primary Examiner*—Gus T. Hampilos
*Assistant Examiner*—Jerold L. Johnson
*Attorney, Agent, or Firm*—Ralf H. Siegemund

[57] ABSTRACT

An apparatus is disclosed for adjusting the inclination of the small sides in a mold for continuous casting, selectively in response to any variations of the mold sides as such, and in response to any variation of the gap between the casting emerging from the mold and the lower end thereof. A feedback loop operating in response to mold side inclination should be responsive to command input which are dependent upon the casting speed.

6 Claims, 1 Drawing Figure

K
14
K=f(vg)
vg
15
4
W
13
11
8
1
3
9
2
10
12
6
5
M
7
S
W'
16

SUPERVISING THE INCLINATION OF MOLD SIDES

BACKGROUND OF THE INVENTION

The present invention relates to an apparatus for initially adjusting the narrow sides of an adjustable mold and for subsequently continually monitoring the inclination and adjusting the same in dependence upon casting parameters in order to maintain, for instance, a particular level of the molten material in the mold.

It is well known that during continuous casting of relatively wide slabs, the casting shrinks in the wide direction during traversal of the mold and in dependence upon the casting speed. For instance, the shrinkage amounts to approximately 0.9% of the casting width for a casting speed of one meter per minute. In order to offset this shrinkage in the mold, it has been practiced to position the narrow sides of the casting mold at a downwardly tapering inclination amounting to a narrowing of the long width of the mold cavity in the direction of casting. The adjustment of the inclination of the sides of the mold is customarily carried out on the basis of empirically obtained parameters and, once adjusted, that inclination is usually not changed during the casting process. This procedure is definetely a disadvantage because the casting speed as a whole is not constant; rather, the casting speed in the beginning as well as at the end amounts to only approximately 15% of the normal mean casting speed observed during steady-state operation. Moreover, if for any reason the inclination (tapering) or reduction in a mold cavity cross section is too large, the friction between casting and mold will increase unduly, causing fissures and cracks to appear in the cast product. If the mold sides are insufficiently inclined, i.e., if they are almost vertically oriented, a gap may form in the lower portion of the mold which will immediately impede the heat transfer from the casting into the mold side which, in turn, causes the casting to be insufficiently cool and the skin which forms in the mold is insufficient to support the casting in its entirety once the casting has left the mold. If the skin, at this point, is too thin, it may readily rupture, particularly when the casting is veered into the horizontal, and the hot metal in the interior may run out.

It can, thus, be seen that, in order to avoid the aforementioned deficiencies, it is necessary to match the inclination of the small sides to the various requirements of the casting during the various phases thereof in order to compensate for the variable shrinkage of the casting throughout the casting process. It is known to adjust the inclination of the narrow sides of the mold for continuous casting on the basis of the heat throughput through these mold sides; for instance, the inclination is increased when, in the lower portion of the mold, the amount of heat transferred into the mold side drops. This approach, however, is disadvantaged by the fact that only the gap formation or the absence thereof can be ascertained. There is very little change in heat transfer if the lower portion of the mold side appears to be, more or less, forced against the passing casting or just engages it. In other words, using heat throughput as a measuring parameter will not indicate too severe a reduction of the mold cross section. Furthermore, ascertaining the tendency of the formation of the gap between the mold side and the casting can temporarily be interfered with if water enters that gap and, at least temporarily, bridges it.

DESCRIPTION OF THE INVENTION

It is an object of the present invention to avoid the deficiencies outlined above and to provide a new and improved apparatus which permits the attaining of a high casting speed under conditions which take into consideration the sensitivity of the casting skin with regard to rupture so that the surface quality of the casting is increased and safety is provided against rupture of the casting skin; also, the life of the mold and the intervals of repair and refinishing should be increased.

It is, therefore, a specific object of the present invention to provide an apparatus for adjusting the inclination of a small side of a mold for continuous casting of slab ingots having rectangular cross sections.

In accordance with the preferred embodiment of the present invention, it is suggested to provide two separate measuring transducers, one for measuring the inclination of the small mold side in relation to the direction of casting, the other one measuring the width of the gap between the casting skin as emerging from the mold and the lower end of the mold at said small mold side; adjusting means are provided, such as an adjusting motor driving an adjusting spindle or the like, being coupled to the mold side for positioning and tilting the same in response to control signals applied to the motor; two separate controllers are provided, each responding to reference signals and but one receiving, as a controlled variable input, the output of the one transducer while the other controller receives the output of the other transducer. A selection is additionally provided to turn over the control of the mold side inclination to one or the other of the two controllers in that one or the other provides the output to the adjusting means, i.e., the spindle motor. The decision which controller takes over is preferably made by a computer on the basis of general casting conditions. Therefore, during the start-up period and until a more or less stationary and steady-state casting operation has been obtained, the control of the mold side inclination is turned over to the controller which responds to the inclination measurement while, once the steady-state operation has been attained, control is turned over to the other controller, and the inclination of the mold side is adjusted in order to obtain a constant gap width as defined.

While the specification concludes with claims, particularly pointing out and distinctly claiming the subject matter which is regarded as the invention, it is believed that the invention, the objects and features of the invention, and further objects, features and advantages thereof, will be better understood from the following description taken in connection with the accompanying drawings.

DETAILED DESCRIPTION

Figure 1:
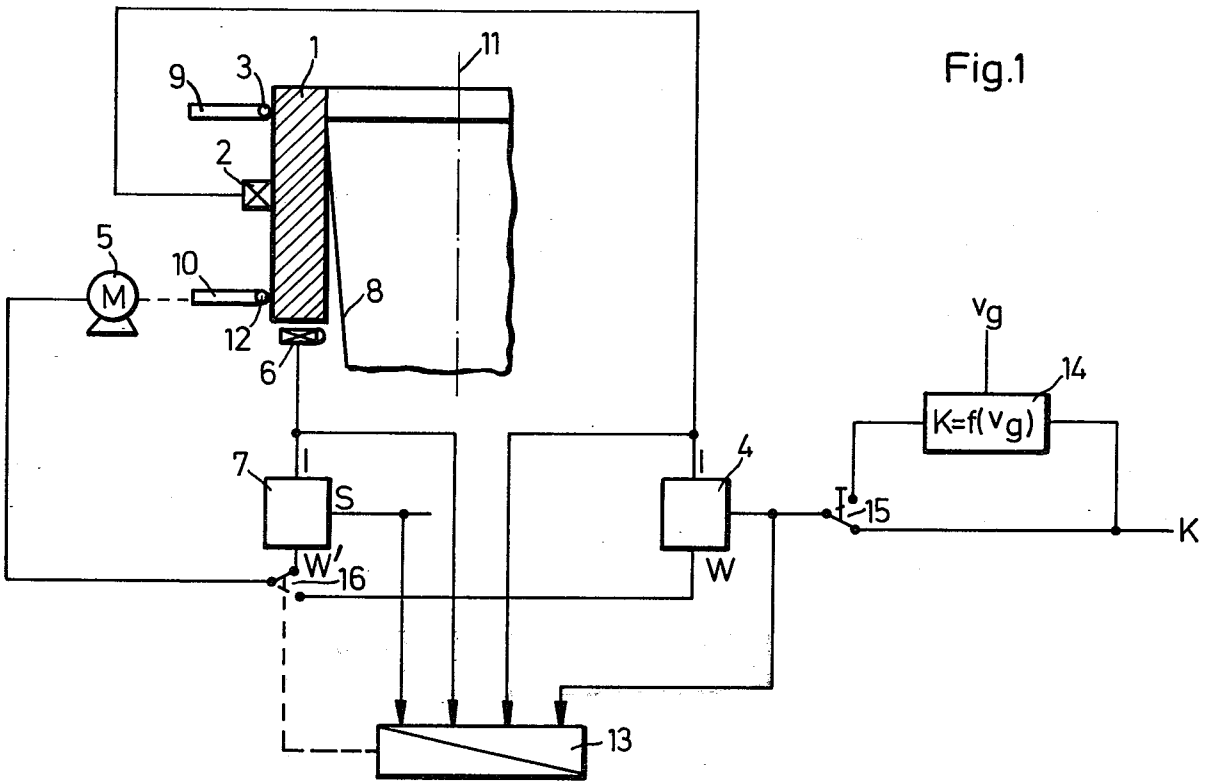
FIG. 1 is a schematic view of the preferred embodiment of the present invention for practicing the best mode thereof.

Proceeding now to the detailed description of drawings, FIG. 1 illustrates a portion of a mold M for continuous casting. This mold includes, in particular, a narrow side 1, shown in cross section. The mold side 1 is provided with the usual cooling channels which have been omitted for the sake of clarity. Also, it is presumed that the mold side is basically made of copper. The mold side 1 is positioned by means of spindles, such as 9 and 10, applied and operated in a conventional manner and provided, in particular, for adjusting the angle of that mold side, for example, in relation to the longitudinal axis 11 of the mold. A vertical position for the side 1 finds the side in parallel relation to axis 11. For this and other operations, the inclination of the mold is to be adjusted and for this purpose the spindles can be advanced and retracted in unequal amounts. The tips of the spindles are respectively connected to the small side 1 by means of joints, hinges, bearings, or the like. Reference numeral 8 refers to the casting and, if the mold side 1 is adjusted to a straight vertical position, shrinkage of the casting in the direction of the broad side causes the surface of the casting to disengage from the mold side, increasing the gap in the direction of casting. An electronic inclination meter 2 is affixed to (or otherwise operatively coupled to) the mold side at a location underneath the upper joint 3. Preferably, one should use here an oil-damped (attenuated) inclination meter which provides a measuring signal that is directly proportional to the deviation of the instrument from the horizontal which, in this case, is identical with the angle of inclination of the mold side 1 relative to its vertical. This measuring result is fed as a controlled variable to a first controller 4 as a feedback signal I. The controller receives, in addition, a reference signal K and provides an output signal W, provided, however, the switch 16 is in the alternative position.

The output signal of the controller 4 is particularly applied to a motor 5 as a correction signal that will drive motor 5 for advancing or retracting the spindle 10, as is required in order to make sure that the inclination of the mold side 1, as measured by instrument 2, agrees with the reference signal K. Depending upon the position of another switch 15, the reference signal K is either a constant value, suitably adjusted in some input network (not shown but provided in a conventional manner). Alternatively, that is for the alternative position of switch 15, the reference signal K is made a function of the casting speed $V_g$; reference numeral 14 denotes a generator of that function wherein, basically, the reference value K is made to decrease with increasing casting speed, preferably in a nonlinear manner. In other words, the inclination should be smaller for higher casting speeds. The function is empirically determined. The casting speed can be acquired by a suitable transducer which measures the rate of progression of the casting at some convenient location downstream from the mold.

The drawing illustrates a second feedback loop. This second feedback loop includes sensor 6 which may, for example, be an eddy current sensor monitoring its proximity to the surface of the casting 8. In particular then, the eddy current measuring transducer 6 responds to its proximity to the surface of the skin of the casting because measuring instrument 6 is disposed directly underneath the mold side and is affixed thereto. The proximity measuring result is fed as an input, i.e., as a controlled variable, to a second controller 7. This variable is, in effect, the representation of the gap width and separation distance of the casting skin from the mold at the point of emergence therefrom. The controller 7 receives a reference signal S and provides, in addition, an output $W^1$ which, in the illustrated position of switch 16, is applied as an alternative to the motor 5 as an alternative correction signal. The motor adjusts the spindle 10 for obtaining a preadjusted and constant gap width.

It can thus be seen that the mold side 1 is provided with a controlled inclination, the control either operating toward a constant or speed-dependent variable inclination or, in the alternative, the inclination is varied in order to obtain a constant separation distance between casting and mold side at the exit of the mold. All of the measuring values, i.e., the output of the transducers 2 and 6, and all of the reference values are fed to a computer 13. This particular computer is programmed to decide which one of the two controllers and which one of the two feedback loops are to determine the inclination of the mold side.

For example, in the beginning of casting, the control must, of course, be turned over to controller 4 because there is no gap to be ascertained; in other words, transducer 6 furnishes too large values that would result in too much of an inclination of mold side 1. After steady-state operation has been obtained in dependence, for example, of a possible, initially varying, but later stabilized speed of casting $V_g$, further control may then be turned over to the loop containing controller 7. If, for example, during casting, the speed changes, then the reference value K may vary, and that variation or change may by and in itself serve as an input for computer 13 in order to turn the control back to the controller 4.

It can thus be seen that the particular arrangement permits optimization in the adaptation of the mold side inclination, particularly with regard to existing casting speeds and other measuring values. A particular mode of operation is possible, in which there is always a minimum gap between mold side and casting skin so that the casting speed, the heat transfer into the mold side, and the friction and friction forces between casting and mold can be matched toward obtaining an optimized set of operating parameters. In particular, it will be avoided that, in the case of an increasing casting, the skin will not fully engage the mold side because that, in turn, will reduce the friction; particularly, it avoids any increase in friction with increasing casting speed. In other words, friction that may interfer with the strength or strengthening of the solidifying skin is avoided. Uniform strength of the skin avoids the formation of cracks and fissures in casting. Moreover, it was found that optimization in the control operation increases the life of the mold and reducers the amount of repair work or the frequency of repair and refinishing work.

The invention is not limited to the embodiments described above; but all changes and modifications thereof, not constituting departures from the spirit and scope of the invention, are intended to be included.

We claim:

1. An apparatus for adjusting the inclination of a small side of a mold for continuous casting of slab ingots having a rectangular cross section, comprising:

first transducer means operatively coupled to the small mold side for detecting an inclination thereof in relation to a direction of casting and providing an output representative thereof;

second transducer means operatively coupled to the small mold side at an end thereof for determining a gap between a casting emerging from the mold and the small mold side and producing an output representative thereof;

adjusting means coupled to the small mold side for positioning and inclining the small mold side in response to control signals received;

first controller means connected to the first transducer means for receiving the output thereof and further connected for receiving a first reference signal indicative of a desired inclination for the small mold side and providing a correction signal in response to the output of the first transducer means and the first reference signal; second controller means connected to the second transducer means for receiving the output thereof and further connected for receiving a second reference signal indicative of a desired gap between the emerging casting and the small mold side, and providing a correction signal in response to the output of the second transducer means and the second reference signal; and selector means operatively associated with said first and second controller means for applying one or the other of the corrective signals as control signals to the adjusting means.

2. An apparatus as in claim 1, the selector means including computing means receiving the output signals of the first and second transducer means and the first and second reference signals to determine which one of the first and second controller means is to be connected to the adjusting means.

3. An apparatus as in claim 1, the first transducer means including an electronic oil-damped inclination-measuring device.

4. An apparatus as in claim 1, there being an upper and a lower adjusting spindle for positioning the small mold side, the lower adjusting spindle being included in the adjusting means, the first transducer means being disposed below the upper, but above the lower, adjusting spindle.

5. An apparatus as in claim 1, said second transducer means including a contactless sensor.

6. An apparatus as in claim 5, said contactless sensor being an eddy current probe.

* * * * *